US012733719B2

(12) United States Patent
Lindstrom

(10) Patent No.: US 12,733,719 B2
(45) Date of Patent: Sep. 15, 2026

(54) JEWELRY HAVING INTERCHANGEABLE DECORATIVE ELEMENTS

(71) Applicant: Flamond Limited, Gibraltar (GI)

(72) Inventor: Adam Lindstrom, Gibraltar (GI)

(73) Assignee: Flamond Limited (GI)

( * ) Notice: Subject to any disclaimer, the term of this patent is extended or adjusted under 35 U.S.C. 154(b) by 0 days.

(21) Appl. No.: 18/816,722

(22) Filed: Aug. 27, 2024

(65) Prior Publication Data

US 2026/0060389 A1 Mar. 5, 2026

(51) Int. Cl.

| | |
|---|---|
| ***A44C 17/02*** | (2006.01) |
| ***A44C 27/00*** | (2006.01) |
| *A44C 7/00* | (2006.01) |
| *A44C 9/00* | (2006.01) |

(52) U.S. Cl.

CPC ..... *A44C 17/0208* (2013.01); *A44C 27/00* (2013.01); *A44C 7/002* (2013.01); *A44C 7/003* (2013.01); *A44C 9/00* (2013.01)

(58) Field of Classification Search

CPC . A44C 17/02; A44C 17/0208; A44C 17/0216; A44C 17/0225

See application file for complete search history.

(56) References Cited

U.S. PATENT DOCUMENTS

| | | | | | |
|---|---|---|---|---|---|
| 481,936 | A * | 9/1892 | Eckert | A44C 5/02 | 7/125 |
| 509,594 | A * | 11/1893 | Cameron | A44C 5/02 | 7/125 |
| 706,911 | A * | 8/1902 | Dunham | A44C 15/0015 | D8/18 |
| 732,245 | A * | 6/1903 | Weiss | A44C 17/0208 | 63/29.1 |
| 738,700 | A * | 9/1903 | Ruby | A44C 17/0208 | 63/29.1 |
| 2,824,474 | A * | 2/1958 | Lawrence | A44C 7/006 | 72/458 |
| 3,483,716 | A * | 12/1969 | Stenzler | A44C 17/02 | 63/29.1 |
| 4,800,738 | A * | 1/1989 | Bunz | A44C 17/005 | 63/26 |
| 8,650,688 | B1 * | 2/2014 | Gasparrini | A44C 27/00 | 7/128 |
| 10,463,119 | B1 * | 11/2019 | Chambers | A44C 5/0061 | |

(Continued)

FOREIGN PATENT DOCUMENTS

| | | | |
|---|---|---|---|
| CH | 583380 | A5 | 12/1976 |
| CN | 206565432 | U | 10/2017 |
| IT | 202019000003533 | U1 | 4/2021 |

OTHER PUBLICATIONS

Extended Search Report for European Application No. 25198237.7, mail date Feb. 27, 2026, 10 pages.

*Primary Examiner* — Emily M Morgan

(74) *Attorney, Agent, or Firm* — Maine Cernota & Curran

(57) ABSTRACT

An item of jewelry having a plurality of interchangeable decorative elements, the jewelry comprising an elastically deformable holding element and the decorative elements comprises a retaining bolt that is protruding from a core of the decorative element and which comprises a head at its end and comprises a constriction between the core and the head, wherein sections of the holding element project into the constrictions.

12 Claims, 3 Drawing Sheets

(56) References Cited

U.S. PATENT DOCUMENTS

| | | | | |
|---|---|---|---|---|
| 2002/0148250 | A1* | 10/2002 | Pratt | A44C 11/002 63/3 |
| 2007/0044512 | A1* | 3/2007 | Smith | A44C 17/0216 63/40 |
| 2009/0242117 | A1* | 10/2009 | Gupta | A44C 17/043 156/539 |
| 2016/0095394 | A1* | 4/2016 | Snider | A44C 19/00 63/3 |
| 2016/0183645 | A1* | 6/2016 | Drouhard | A44C 17/0216 63/15 |
| 2016/0334645 | A1* | 11/2016 | Canada | A44C 5/0084 |
| 2024/0041169 | A1* | 2/2024 | Fabbri | A44C 17/0225 |

* cited by examiner

JEWELRY HAVING INTERCHANGEABLE DECORATIVE ELEMENTS

FIELD OF THE INVENTION

The invention relates to jewelry, such as a ring, earring, bracelet or necklace, comprising interchangeable decorative elements.

BACKGROUND OF THE INVENTION

Jewelry is usually very expensive, therefore, potential buyers often cannot afford buying a new ring or necklace unless they save money for a longer period of time. Furthermore, if a specific item of jewelry was bought, the number of gemstones in a ring, earring bracelet or necklace may only be changed by a goldsmith. However, it would be advantageous if a private person may change the number of gemstones in a ring or earring without any particular effort.

In the respective field of the art necklaces are known on which a user can fix additional elements or remove them depending on his preference. Furthermore, bracelets are known which are initially designed as a simple chain and to which further pendants, such as decorative elements or souvenirs from city trips or the like, can be added.

Based on this prior art, the technical problem of the present invention may be seen in providing jewelry on which elements can be exchanged and securely attached by a private user, i.e. a person which is not a goldsmith. According to the present invention it will be possible to replace small elements not comprising a gemstone by elements comprising a gemstone in an item of jewelry so that the number of gemstones in a ring, earring, bracelet or necklace can be expanded. Furthermore, according to the present invention it should be possible to remove elements comprising a gemstone in an item of jewelry, for example a ring, and insert and securely attach said elements into an earring or bracelet, if a user prefers to wear earrings comprising a higher number of elements comprising a gemstone.

SUMMARY OF THE INVENTION

In accordance with the invention, the above object can be accomplished by providing an item of jewelry formed of a carrier body comprising a holding element and two or more interchangeable decorative elements, wherein said holding element comprises apertures or openings which are elastically deformable so that a decorative element can be attached to the holding element via said aperture or opening and fixed therein. Each decorative element comprises a retaining bolt that is protruding from a core of the decorative element and which comprises a head at its end and a constriction on the retaining bolt which is present in an area below the core and prior to the head. According to the present invention, sections of the holding element around the aperture or opening project into and surround the respective constriction of a retaining bolt. The jewelry usually has at least 2 interchangeable decorative elements and preferably at least 6 interchangeable decorative elements. In some embodiments the constriction is an area of the retaining bolt where its thickness, cross-section and/or diameter is smaller than the thickness, cross-section and/or diameter of the head of the retaining bolt. In other embodiments at least one dimension of the constriction in the transverse direction which should be used to attach the retaining bolt, is smaller than the corresponding dimension at the head. Thus, a form-fit connection can be generated such that the decorative elements can be removed by elastically deforming the holding element. According to the present invention, an item of jewelry is provided, wherein the user can easily attach or substitute decorative elements. For example, a customer may buy a ring formed of a carrier body comprising a holding element, two or more interchangeable decorative elements and at least one decorative element comprising a gemstone such as a diamond. Thus, initially said ring comprises only one decorative element comprising a gemstone, such as a diamond, wherein the other decorative elements are place-holders which do not comprise a gemstone. These place-holder decorative element(s) can be substituted with decorative elements comprising a gemstone, such as a diamond or the like.

Preferably, the holding element is band-shaped and is arranged at a base (bottom surface) of a groove formed in a carrier body of the jewelry. The groove comprises a narrowing at a distance from the base of the carrier body so that the narrowing prevents a removal of the holding element from the groove formed in the carrier body. The term "band-shaped" means that the holding element is formed of a material having a small thickness, wherein said holding element has a longitudinal and a transverse dimension, wherein the longitudinal dimension is much larger that the transverse dimension.

Preferably, the groove formed in the carrier body has at least one lateral wall, wherein the two or more interchangeable decorative elements are in areal contact with the at least one lateral wall. The areal (preferably a flat areal) contact prevents the decorative elements from moving along a longitudinal axis relative to the carrier body of the jewelry. More preferably the groove has two lateral walls, and the decorative elements are in areal contact with both lateral walls. Thus, the position of the decorative elements can be fixed. Preferably, lateral walls are formed perpendicular to the base (bottom surface) of the carrier body of the decorative element.

Furthermore, the groove formed in the carrier body can preferably comprise a plurality of bores in which the retaining bolts of the decorative elements are at least partially received. In preferred embodiments the bores are arranged at a base (bottom surface) of the groove. In the case of an annular item of jewelry, for example a ring, earring or bracelet, the bores are oriented in a radial direction with respect to the radial center of said jewelry.

As outlined above, the holding element is preferably band-shaped, and it has a plurality of apertures or openings for receiving the retaining bolts of the decorative elements. These apertures or openings can have a round, oval or rectangular shape.

According to the present invention each decorative element comprises a retaining bolt that is protruding from a core of the decorative element and which comprises a head at its end and a constriction between the core and the head. Preferably, the retaining bolt of the decorative element and its head protrude from the core to such a length that the carrier body of the jewelry does not come into direct contact with the retaining bolt of the decorative element after having been inserted into the holding element. However, this does not mean that for example when removing the decorative element from the holding element or when the holding element is displaced in the groove in its axial direction, contact may occur between the retaining bolt and/or its head and the carrier body of the jewelry. However, this contact is neither intended nor desired according to the present invention. This contact has no significance beyond the fact that a certain positioning of the decorative element relative to the jewelry can be achieved. This aspect is to be considered as a difference to known fastening-methods of jewelry, such as simple ear studs, which also may comprise a bolt- or pin-shaped holding element, but which have any kind of fastening element directly supported on that holding element.

Thus, according to the present invention, a positioning of the decorative element within the jewelry is determined in at least one direction, preferably in the longitudinal direction, by the position of the aperture or opening formed in the holding element after having been inserted into the holding element. No further bearing or guiding means are needed for positioning the decorative element in the holding element of the jewelry.

The bores which are provided in the groove of the carrier body, can have a diameter which is at least 10%, preferably at least 20%, larger than the maximum diameter of the head of the retaining bolt of the decorative elements. Thus, a somewhat bigger space is formed which is advantageous to provide enough space for the edge area of the apertures or openings of the holding element to slide over the head of the retaining bolt, when the decorative element is assembled.

Furthermore, in a preferred embodiment, the thickness of the holding element can be at least as big as the difference of the diameter of the afore-mentioned bore or opening to the maximum diameter of the head of the retaining bolt. Also, in a preferred embodiment the thickness of the holding element can be less than the triple of the difference of the diameter of the afore-mentioned bore or opening to the maximum diameter of the head of the retaining bolt. The maximum diameter of the head is measured perpendicular to the longitudinal direction of the retaining bolt. These ratios guarantee a secure hold of the decorative element in the holding element and also allow a smooth removal when the decorative element is to be exchanged.

Furthermore, it is advantageous if a part of the head of the retaining bolt comprises a contact surface with the holding element and the contact surface is inclined to the longitudinal direction of the retaining bolt in such a manner that an axial force is exerted on the decorative element to hold it by the holding element.

In one preferred embodiment the holding element can be formed of a steel strip which can be arranged in the groove of the carrier body, said steel strip comprising apertures or openings for the retaining bolts of the decorative elements. The steel strip is a preferably formed of a spring steel strip and has preferably a flat shape. The apertures or openings formed in the steel strip preferably do not have a circular form. At least one resilient element can be provided on the surface of the steel strip to improve the attachment of the decorative element to the holding element of the jewelry and/or to reduce wear of the holding element during joining or removal of the decorative element.

In another embodiment the holding element can be formed of a plastic material, preferably an elastomer and more preferably nylon or polypropylene (PP) or polyacrylate (PA) or ultra-high-molecular-weight polyethylene (UHMWPE).

Furthermore, in a preferred embodiment a carrier body of an item of jewelry can have an arcuate shape and can optionally be formed in a ring-like manner. The carrier body preferably comprises a groove which is formed in an outwardly facing side of the carrier body and several bores are arranged at the bottom of the groove. In a preferred embodiment the groove comprises a constriction which is spaced apart from the bottom of the groove, and the outwardly facing side of the carrier body comprises a plurality of flat outer surfaces and the flat outer surfaces are aligned centrally and perpendicular to the bores. The size of the flat outer surfaces corresponds to the size of the rear sides of the decorative elements which are to be arranged on them.

In a preferred embodiment the decorative elements to be inserted into an item of jewelry can have a square form, wherein on the surface of the decorative element a gemstone is present. Preferably, said decorative elements comprise on a bottom side a retaining bolt which protrudes at the side that is opposite to the surface side, wherein the retaining bolt has a head at its free end and a constriction which is arranged at a distance between the head and the surface side. In a preferred embodiment the constriction has a smaller cross-section than the head and a projection is arranged starting from the square basic shape centrally to the retaining bolt. In a preferred embodiment the projection has a square-shaped cross-section. The decorative element can comprise fastening arms for fastening a gemstone, such as a diamond, that are arranged on a surface side.

In another aspect the present invention also provides a tool for removing a decorative element from an item of jewelry which tool usually can be made of a sheet metal, said tool having a flat surface which comprises an offset region which is offset with respect to the flat surface, wherein the offset region comprises an actuator pin, said actuator pin having a cross-section with a maximum length of 1.2 mm.

In another aspect the present invention provides a method of attaching to and/or removing from an item of jewelry a decorative element, wherein the jewelry is formed of a carrier body comprising a holding element and two or more interchangeable decorative elements, wherein said holding element comprises apertures or openings which are elastically deformable so that a decorative element can be attached to the holding element via said aperture or opening and fixed therein, comprising a step of moving a head of a retaining bolt of the decorative element through one of the apertures or openings so that the holding element is elastically deformed and thereafter released so that the decorative element is fixed in the holding element. When the decorative element is removed from the jewel, a tool is pressed onto an end surface of the head in order to cause elastic deformation on the holding element to release the connection. The forces for attachment and removal are substantially equal. "Substantially equal" is understood in that the forces vary in a range of +/−40%. When these forces would differ more, a deformation of the holding element may be too big and harmful for the structure of the material.

One embodiment of the present disclosure provides jewelry having interchangeable decorative elements, the jewelry comprising: a carrier body comprising a holding element, the holding element comprising at least one elastically deformable aperture or opening; and at least one decorative element comprising: a core; a retaining bolt protruding from the core, the retaining bolt further comprising a head disposed opposite the core; and a constriction disposed between the core and the head, wherein the at least one elastically deformable aperture or opening of the holding element is configured to receive the head of the at least one decorative element and to project into the constriction upon further insertion of the at least one decorative element.

Another embodiment of the present invention provides such jewelry wherein the holding element is band-shaped and is arranged at the base of a groove formed in the carrier body, the groove comprising a narrowing at a distance from the base of the carrier body, and wherein the narrowing is configured to prevent removal of the holding element from the groove formed in the carrier body.

A further embodiment of the present invention provides such jewelry wherein the groove comprises at least one lateral wall and wherein the at least one decorative element is in areal contact with the at least one lateral wall when disposed in the holding element.

Yet another embodiment of the present invention provides such jewelry further comprising a steel strip arranged in the groove of the carrier body, wherein said steel strip comprises openings configured to receive the retaining bolt of the at least one decorative element.

A yet further embodiment of the present invention provides such jewelry wherein the groove formed in the carrier body comprises a plurality of bores in which the retaining bolts of the decorative elements are configured to be at least partially received.

Still another embodiment of the present invention provides such jewelry wherein the plurality of bores are arranged at a base of the groove having a diameter which is at least 3% larger than the maximum diameter of the head of the retaining bolt.

A still further embodiment of the present invention provides such jewelry wherein the thickness of the holding element is at least as big as the difference of the diameter of the bores to a maximum extension of the head of the retaining bolt, and/or wherein the thickness of the holding element is less than three times the difference of the diameter of the bores to the maximum extension of the head of the retaining bolt.

Even another embodiment of the present invention provides such jewelry wherein the holding element is band-shaped, and comprises a plurality of elastically deformable apertures and/or openings configured to receiving the retaining bolt of the at least one decorative element.

An even further embodiment of the present invention provides such jewelry wherein the position of the decorative element within the jewelry is determined in at least one direction by the position of the holding element.

A still even another embodiment of the present invention provides such jewelry wherein, in use, the holding element is configured to be in contact with a part of the head of the retaining bolt at a contact surface and the contact surface is inclined to the longitudinal direction of the retaining bolt, such that an axial force is exerted on the decorative element to hold it in its position.

A still even further embodiment of the present invention provides such jewelry wherein the holding element is made of a plastic material.

Still yet another embodiment of the present invention provides such jewelry wherein the carrier body further comprises: a plurality of flat outer surfaces disposed in an outward facing side of the carrier body; a groove disposed in the outward facing side of the carrier body; a plurality of bores arranged at a base of the groove; and a narrowing spaced apart from the base of the groove, wherein the flat outer surfaces are aligned centrally and perpendicular to the bores, and wherein the carrier body has an arcuate shape.

One embodiment of the present disclosure provides a jewelry kit comprising: the jewelry of embodiments; and a tool for removing a decorative element from the jewelry of embodiments, the tool comprising: a flat base surface; and an offset region, which is offset with respect to the flat base surface, wherein the offset region comprises an actuator pin, and wherein the actuator pin has a cross-section with a maximum length of 1.2 mm.

One embodiments of the present disclosure provides a method for attaching to and/or removing a decorative element from the jewelry of embodiments, the method comprising: providing jewelry in accordance with the teachings of claim 1; during a fastening movement, moving a head of the retaining bolt of the decorative element through one of the apertures or openings, elastically deforming the holding element, until the holding element projects into the constriction; providing a tool comprising: a flat base surface; and an offset region, which is offset with respect to the flat base surface, wherein the offset region comprises an actuator pin, and wherein the actuator pin has a cross-section with a maximum length of 1.2 mm; and during a removal movement, pressing the tool onto an end face of the head to cause elastic deformation of the holding element and release the holding element from the constriction.

Another embodiment of the present disclosure provides such jewelry wherein the forces required to complete the fastening movement and removal movement are substantially equal.

One embodiment of the present invention provides a decorative element for jewelry, the decorative element comprising: a surface side, a retaining bolt protruding from a side opposing the surface side, wherein the retaining bolt comprises a head at a free end, distal from the surface side, and a constriction disposed between the head and side opposing the surface side, wherein the constriction has a smaller cross-section than the head, wherein the decorative element has a square shape, wherein a projection is arranged starting from the square shape centrally to the retaining bolt, and wherein the projection has a square-shaped cross-section.

Another embodiment of the present disclosure provides such a decorative element, further comprising fastening arms configured to allow a gemstone to be fastened thereto disposed on the surface side.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

The following Figures are described in the present application.

DETAILED DESCRIPTION OF THE INVENTION

Figure 1:
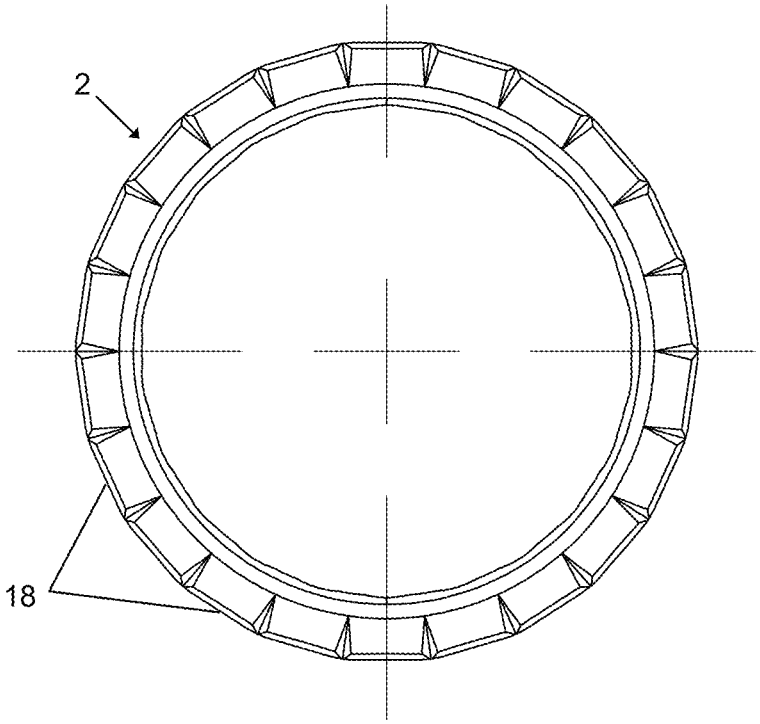
FIG. 1 a top view of an item of jewelry which is embodied as a ring.
Figure 2:
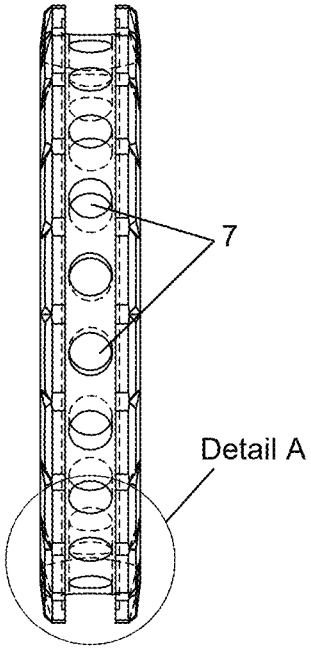
FIG. 2 a side view of the ring of FIG. 1.
Figure 3:
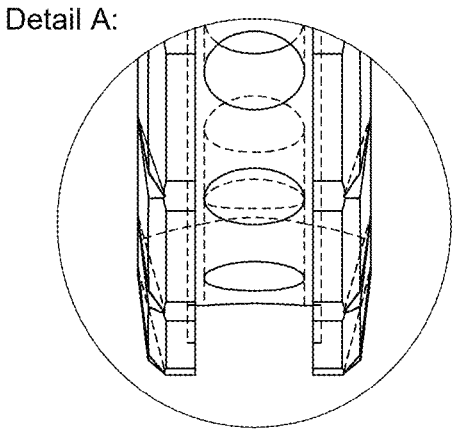
FIG. 3 the detail A of FIG. 2.
Figure 4:
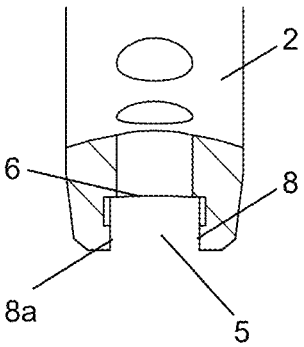
FIG. 4 a cross-sectional view of the detail of FIG. 3.
Figure 5:
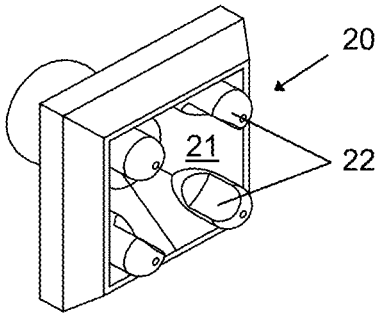
FIG. 5 a view of a surface side of a decorative element 20 for the jewelry 1 of FIG. 1, FIG. 6 a rear view of the decorative element 20 of FIG. 5, FIG. 7 a top view of a holding element 40, with which the decorative elements 20 are hold at the jewel, FIG. 8 an alternative embodiment of the jewelry 1, which is embodied as an earring, FIG. 9 a cross-sectional view of the decorative element in the state when it is attached to the jewel, FIG. 10 an alternative embodiment of the invention, FIG. 11 a tool for removing decorative elements 20 from the jewel, FIG. 12 a cross-sectional view of a spring steel band used in the embodiment of FIG. 10, and in FIG. 13 a further alternative embodiment of the invention is shown.
Figure 6:
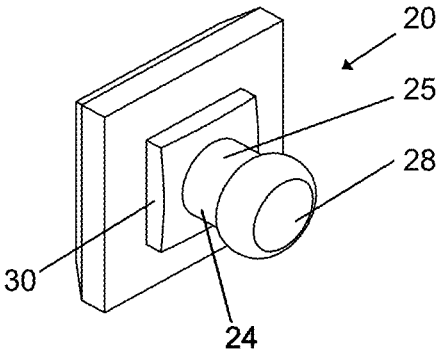
Figure 7:
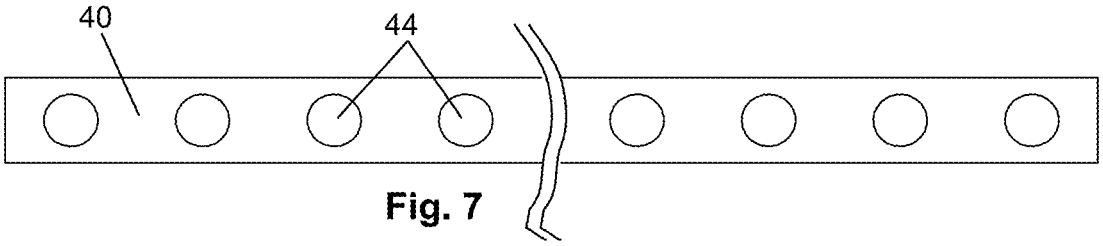

To be more concrete, the present invention may be illustrated as follows:

An item of jewelry usually comprises a carrier body 2 as shown in FIGS. 1 to 4, said carrier body 2 comprising a holding element 40 as shown in FIG. 7 and two or more interchangeable decorative elements 20 as shown in FIGS. 5 and 6. These components can be assembled to the jewelry 1, as it is shown in the cross-sectional view of FIG. 9.

Usually, the carrier body 2 of the jewelry 1 has a groove 5 on a radial outer side. This groove 5 has lateral walls 8 on both sides and narrows with a shoulder that is radially outwardly of a base 6 of the groove 5, thus defining a narrowing 8*a* of the groove 5. The holding element 40 is accommodated next to the base (bottom surface) 6 of the groove 5 and its radial position (in relation to the ring-shaped jewelry 1) is secured by the narrowing 8*a*. To mount the holding element 40 into the groove 5, it must be deformed with an appropriate force until it overcomes the bottleneck of the constriction of the narrowing 8*a* and slides into the free space provided for it adjacent to the base (bottom surface) 6 of the groove 5.

Preferably, the carrier body 2 of the jewelry 1 comprises bores 7 and the holding element 40 comprises corresponding apertures or openings 44. The bores 7 are preferably round. The apertures or openings 44 usually also have a round shape, but other shapes are also conceivable, such as for example an oval shape. After the holding element 40 has been inserted into the groove, it still needs to be adjusted in its longitudinal position so that the bores 7 and openings 44 are aligned with each other. As the thickness of the holding element 40 is adjusted to the thickness which is formed by the distance from the base 6 of the groove 5 to the narrowing 8*a*, further fastening means such as bonding usually are not necessary to fix the holding element 40 but may additionally be used. The shape of the apertures or openings 44 can be oval in order to achieve a certain tolerance with regard to the dimensional deviations of the distances between the bores 7 and apertures 44 of different decorative elements 20.

As shown in FIG. 6, the decorative elements 20 each have a retaining bolt 25 on their rear side, which protrudes like a pin and comprises a bulge at its free end, which is referred to as the head 28. An area with a reduced diameter is arranged between the head 28 and the base body of the decorative element 20, which is referred to as a constriction 24. Even if these elements are drawn and described here as rotationally symmetrical, other geometries are also conceivable and are fall within the scope of protection of the invention. Functionally, it is important that at least at one point of the free end of the retaining bolt 25 there is a radially protruding region which protrudes relative to a middle of the retaining bolt 25. The head 28 may have an arc-shaped cross-section, in such a way that at its biggest lateral extension a tangent of the arc is in the retaining bolt's longitudinal direction. The arc-shaped cross-section is in contact with the constriction and has an orientation with a tangent which is facing radially outwardly (within a range of 20°). The constriction 24 has preferably a cylindrical shape.

Figure 9:
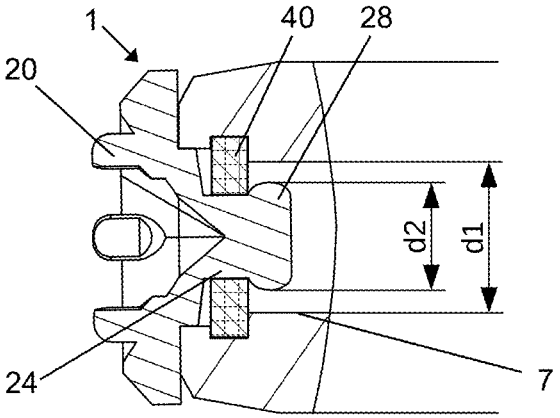
Figure 10:
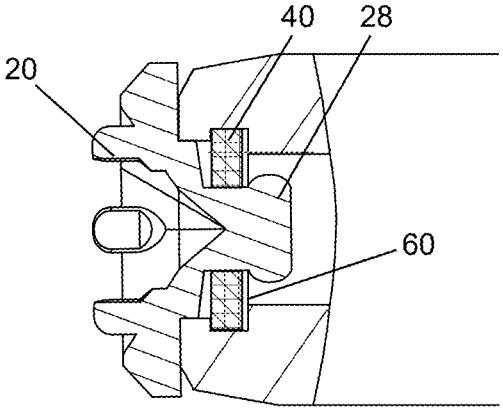
Figure 11:
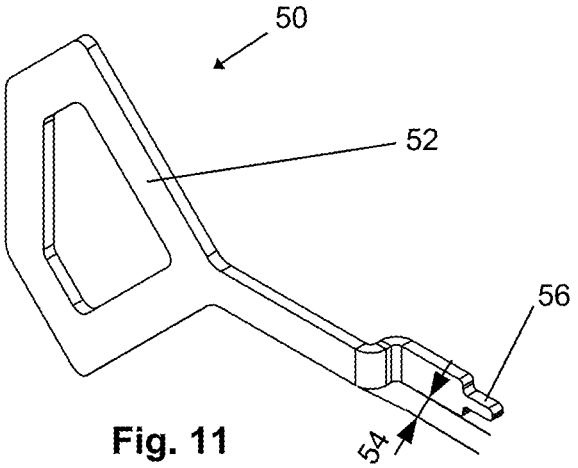

In addition, a square projection 30 is shown in FIG. 6, which is arranged centrally on the rear or inner side of the decorative element 20 and from which the retaining bolt 25 protrudes. The projection 30 does not necessarily have to be square-shaped, but should at least comprise a flat surface, which is preferably perpendicular to the base surface of the rear side of the decorative element 20. The projection 30 should provide a contact with the lateral wall 8 or narrowing 8*a* of the groove 5, as can be seen in FIG. 9 or 10, so that a rotational movement of the decorative element 20 is prohibited. In other words, due to the projection 30 and its flat contact with the groove 5, the decorative element 20 cannot rotate in its seat.

FIG. 5 shows the surface side 21 of the decorative element 20, which is opposite to the rear side. An embodiment providing four fastening arms 22 is shown in FIG. 5, with which a gemstone, such as a diamond, can be fastened to the decorative element 20. Many other variants of the design of the surface side 21 are conceivable, such as specially colored designs or structures, symbols, such as preferably lucky symbols or letters, numbers or the like.

Figure 8:
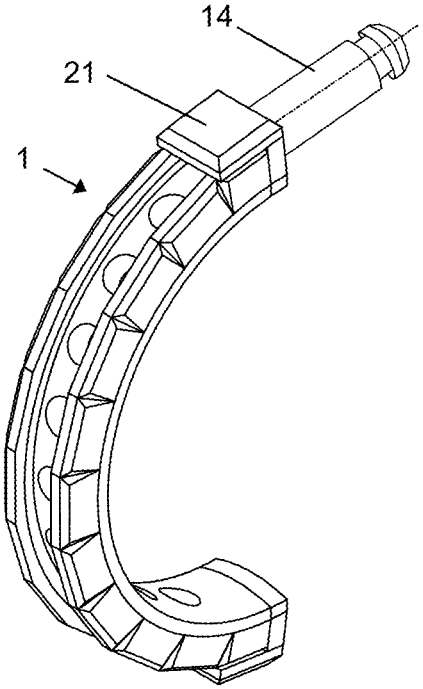

FIG. 8 shows an embodiment of the jewelry 1 that is designed as an earring, in particular a half hoop earring. For this purpose, an ear stud 14 is formed at one end of the jewelry 1, which has a pin-like section that is inserted through the earlobe and a fastening element will be attached to a groove of the pin-section, which however is not shown.

An important aspect of the present invention is that the decorative elements 20 can be removed from the jewelry 1, replaced and remounted by the user himself. On the one hand, these assembly and disassembly processes should be as simple, on the other hand, unintentional loss of a decorative element 20 should be prevented. This is achieved by the geometries and dimensions as shown in FIG. 9. The thickness of the material of the holding element 40 is important. This thickness must be adapted to the difference between the diameter d1 of the bore 7 and the maximum extension d2 of the head 28 of the retaining bolt 25 as will be discussed in the following:

The maximum extension d1 of the bore 7 is bigger than the diameter d2 of the head 28. Preferably, it is at least 3% bigger and preferably at least 5%. Tests have shown that the fastening of the decorative element 20 is less reliable if the diameter d1 is more that 10% bigger than d2. The diameter d1 of the bore 7 of the holding element 40 should be approximately three times the thickness of the holding element 40. In other words, it is advantageous if the thickness of the holding element 40 is between 0.2 and/or 0.45 of diameter d1 of the bore 7.

The diameter d2 of the head 28 is preferably bigger than 1.2 times the inner diameter of the holding element. Also, and/or in addition, the diameter d2 of the head 28 can be preferably smaller than 1.4 times the inner diameter of the holding element 40. This guarantees a considerable mechanical deformation which on the other hand may not be too big to avoid harm at the holding element's material.

When the decorative element 20 is inserted into the jewelry 1, the head 28 of the retaining bolt 25 initially comes into contact with the holding element 40. When the joining force increases, the holding element 40 is deformed in two different ways. Firstly, portions of the holding element 40 located close to the aperture 44 are displaced in the direction of the joining movement. Due to the thickness of the holding element 40, however, this first deformation is limited, so that also a second deformation occurs in the radial direction of the aperture 44. In other words, the aperture 44 expands during the second deformation. After the head 28 is pressed with its maximum expansion through the aperture 44 of the holding element 40, the forces on the holding element 40 reduce and it returns to its original shape. In particular, only an elastic deformation takes place.

The difference or ratio of the maximum diameter d2 of the head 28 and the inner diameter d1 of the bore 7 is also an important parameter. In some preferred embodiments, this difference can be equal to the double of the thickness of the holding element 40, preferably within a range of +/−30%, more preferably in a range of +/−10%. Tests have shown that when using this ratio, the decorative element 20 can be held securely and stably. For small thicknesses of the holding element 40, the ratio d1/d2 should be smaller, thus closer to 1.

Figure 12:
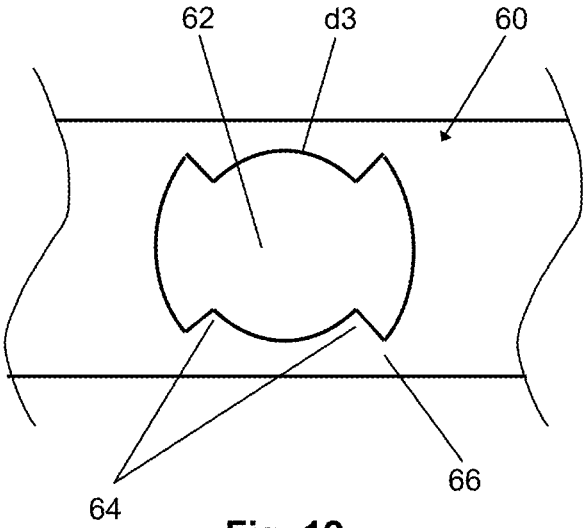

For a secure fastening of the decorative element 20, contact between the edge of the aperture 44 that is adjacent to the head 28, and the head 28 is important. Optionally, this contact can be strengthened by a spring steel strip 60 (see FIGS. 10 and 12), which during assembly can be first inserted into the groove 5 followed by an insertion of the holding element 40. The spring steel strip 60 can be made of a stainless material with a rather low thickness of between 60 to 100 μm, preferably 70 to 80 μm, and a diameter d3 that corresponds to the size aperture 44. In particular, the spring steel strip 60 can have the same length as the holding element 40. If the aperture 44 of the holding element 40 is not round, the spring steel strip 60 preferably also has an aperture or opening 62 having said geometry, at least in sections. During the joining movement, deformation zones 64 move in the joining direction. In addition, the spring steel strip has certain lateral expansions that lead to a weakening of the material (due to a reduced width of the material by cut-outs) and this is shown in FIG. 12 as torsion zones 66. During the joining movement of the decorative element 20, an elastic and rotational deformation of the torsion zone 66 (in the longitudinal direction of the spring steel strip) limits the joining force.

After the decorative material 20 has been inserted, a portion of the holding element 40 is in contact with (or oriented to) the constriction 24 and also in contact to an upper part of the head 28. This portion which is in contact to an upper part of the head 28, is the inner edge of the holding element 40 (see FIG. 9 on the right side). At this edge (residual) forces are preferably maintained in the longitudinal direction of the holding element 40, which forces ensure that the decorative element 20 is stably retained in a position on the outer surface 18 of the carrier body 2 of the jewelry 1. The back of the decorative element is flat (apart from the projection 30) and on the outwardly directed side the decorative elements 40 inserted into the carrier body 2 form flat outer surfaces 18 (see FIG. 1) and these flat surfaces are in areal contact with each other.

In a further aspect of the present invention a tool 50 is provided so that the user can replace the decorative elements 20 himself. This tool 50 is usually made of sheet metal and has a flat surface which comprises an offset region 54 which is offset with respect to the flat surface. An actuator pin 56 is located at a free end of the offset 54. To remove a decorative element 20, the user lays the tool 50 flat on a surface, such as a table. The height of the actuator pin 56 above the table level then corresponds to the center of the head 28 of the decorative element 20 when the jewelry is also placed on that table. This makes it easy for the user to align the actuator pin with the center of the head 28 so that he can easily exert a release force on the decorative element 20 in a force-dosed manner. For a good hold of the decorative element 20 the holding forces and assembly forces are bigger than 10 Newton. Preferably, these forces can be bigger than 20 N.

If the jewelry 1 is designed as a finger ring, it may be adapted to different finger or ring sizes. There are two options for realizing it: In a first variant, the inner diameter of the ring is reduced until the desired ring size is achieved. In a second variant, it is possible not to provide the jewelry 1 with the holders for the decorative elements 20 evenly and without interval all the way around. Instead, an area without decorative elements can be provided. For example by extending or shortening this interval, the ring can easily be produced in different ring sizes.

Figure 13:
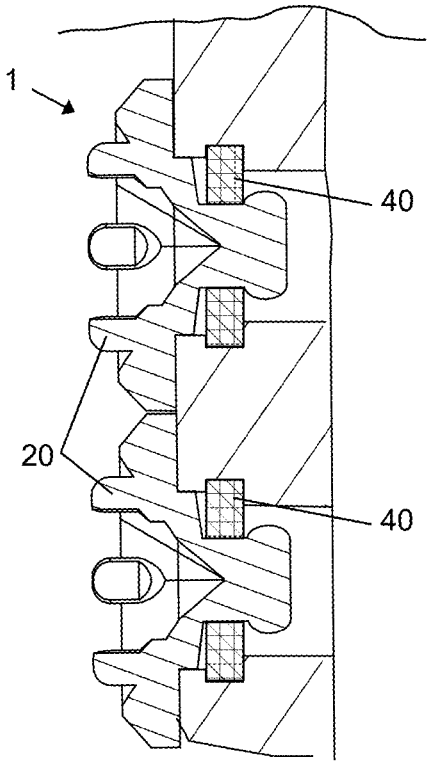

FIG. 13 shows that two-dimensional areas or arrays of decorative elements are also feasible. For this purpose, a carrier body 2 is used for the jewelry 1, which has several grooves for the holding elements 40, which are preferably arranged parallel to each other and at a small distance from each other, so that the decorative elements 20 are not only arranged one after the other in a longitudinal direction of the holding element 40, as already described, but also next to each other, as shown in FIG. 13.

The material of the carrier body of the jewelry is preferably a metal such as silver, gold or gold or silver-plated metal. In a preferred embodiment the material of the carrier body may be gold or a less valuable steel material which may be coated by gold or silver or graphene.

REFERENCE NUMERALS

1 jewelry
2 carrier body
5 groove
6 base
7 bore
8 lateral wall
8*a* narrowing
14 ear stud
18 flat outer surfaces
20 decorative elements
21 surface side
22 fastening arms
24 constriction
25 retaining bolt
28 head
30 projection
40 holding element
44 aperture
50 tool
52 (flat) base surface
54 offset
56 actuator pin
60 steel strip
62 opening
64 deformation zone
66 torsion zone

The invention claimed is:

1. A jewelry kit, the jewelry kit comprising:

jewelry having interchangeable decorative elements, the jewelry comprising:

a carrier body comprising a holding element, the holding element comprising at least one elastically deformable aperture or opening; and at least one decorative element comprising:

a core;

a retaining bolt protruding from the core, the retaining bolt further comprising a head disposed opposite the core; and a constriction disposed between the core and the head, wherein the at least one elastically deformable aperture or opening of the holding element is configured to receive the head of the at least one decorative element and to project into the constriction upon further insertion of the at least one decorative element; and a tool for removing a decorative element from the jewelry, the tool comprising:

a flat base surface; and an offset region, which is offset with respect to the flat base surface, wherein the offset region comprises an actuator pin wherein the actuator pin has a cross-section with a maximum length of 1.2 mm.

2. The jewelry of claim 1, wherein the holding element is band-shaped and is arranged at the base of a groove formed in the carrier body, the groove comprising a narrowing at a distance from the base of the carrier body, and wherein the narrowing is configured to prevent removal of the holding element from the groove formed in the carrier body.

3. The jewelry of claim 2, wherein the decorative element comprises a projection, which is arranged centrally on a rear or an inner side of the decorative element, said projection comprising a flat surface, wherein the groove comprises at least one lateral wall and wherein the projection of the at least one decorative element is in contact with the at least one lateral wall when disposed in the holding element.

4. The jewelry of claim 2, further comprising a steel strip arranged in the groove of the carrier body, wherein said steel strip comprises openings configured to receive the retaining bolt of the at least one decorative element.

5. The jewelry of claim 2, wherein the groove formed in the carrier body comprises a plurality of bores in which the retaining bolts of the decorative elements are configured to be at least partially received.

6. The jewelry of claim 5, wherein the plurality of bores are arranged at a base of the groove having a diameter which is at least 3% larger than the maximum diameter of the head of the retaining bolt.

7. The jewelry of claim 5, wherein the thickness of the holding element is at least as big as the difference of the diameter of the bores to a maximum extension of the head of the retaining bolt, and/or wherein the thickness of the holding element is less than three times the difference of the diameter of the bores to the maximum extension of the head of the retaining bolt.

8. The jewelry of claim 1, wherein the holding element is band-shaped, and comprises a plurality of elastically deformable apertures and/or openings configured to receiving the retaining bolt of the at least one decorative element.

9. The jewelry of claim 1, wherein the position of the decorative element within the carrier body is determined in at least one direction by the position of the holding element.

10. The jewelry of claim 1, wherein, in use, the holding element is configured to be in contact with a part of the head of the retaining bolt that is inclined to the longitudinal direction of the retaining bolt, such that an axial force is exerted on the decorative element to hold it in its position.

11. The jewelry of claim 1, wherein the holding element is made of a plastic material.

12. The jewelry of claim 1, wherein the carrier body further comprises:

a plurality of flat outer surfaces disposed in an outward facing side of the carrier body;

a groove disposed in the outward facing side of the carrier body;

a plurality of bores arranged at a base of the groove; and a narrowing spaced apart from the base of the groove, wherein the flat outer surfaces are aligned centrally and perpendicular to the bores, and wherein the carrier body has an arcuate shape.

* * * * *